United States Patent [19]
Ferris et al.
[11] 4,371,166
[45] Feb. 1, 1983

[54] CYLINDRICAL PUZZLE

[75] Inventors: Daniel B. Ferris, New York, N.Y.; Martin M. Trossman, Washington Township, Washington County, N.J.; Charles R. Luchsinger, Glen Cove, N.Y.

[73] Assignee: Synergistics Research Corporation, New York, N.Y.

[21] Appl. No.: 242,459

[22] Filed: Mar. 11, 1981

[51] Int. Cl.[3] ..... A63F 9/12
[52] U.S. Cl. ..... 273/157 R; 46/17; 217/44
[58] Field of Search ..... 273/156, 157 R, 160; 46/17, 23, 24, 29, 30, 31; 217/44, 49

[56] References Cited

U.S. PATENT DOCUMENTS

| | | | |
|---|---|---|---|
| 417,561 | 12/1889 | Hyatt | 217/44 |
| 496,818 | 5/1893 | Cornforth | 217/49 |
| 745,892 | 12/1903 | Orr | 217/44 |
| 3,704,892 | 12/1972 | Moravick et al. | 273/157 R |
| 4,040,630 | 8/1977 | Brattain | 273/157 R |

OTHER PUBLICATIONS

Master Builder Toy, Inc. Advertisement, Playthings, Mar. 1949, pp. 209.

*Primary Examiner*—Anton O. Oechsle
*Attorney, Agent, or Firm*—Wigman & Cohen

[57] ABSTRACT

A geometric puzzle in the general shape of a cylinder is disclosed. The puzzle is comprised of eight side segments of identical outside dimensions and top and bottom portions of similar dimensions. Each top and bottom portion has a plurality of pairs of posts of different or the same diameters. The eight side segments each have two pairs of holes the diameters of which match those of the posts, when properly assembled to the top and bottom pieces. A cylindrical liner, printed with the indicia of a beverage can, fits over the assembled ten pieces. In addition, a clear plastic liner is provided to fit over the printed liner.

12 Claims, 3 Drawing Figures

CYLINDRICAL PUZZLE

BACKGROUND AND SUMMARY OF THE INVENTION

This invention relates to puzzles, and more particularly to a geometric puzzle that is configured in the shape of a 12-ounce beverage can and may preferably be a beer can. It consists of a removable plastic sleeve which may be printed with the name of a canned beverage. Alternately, a cylindrical sleeve made from, for example, cardboard or any other suitable material, may be placed between a clear, non-printed sleeve and the assembled pieces which form the remainder of the puzzle. The cardboard sleeve would have printed thereon the same indicia as described above in connection with the printed plastic sleeve embodiment.

The remainder of the puzzle consists of ten pieces which, when assembled the proper way, form a replica of a 12-ounce beverage container.

DETAILED DESCRIPTION OF PREFERRED EMBODIMENT

Figure 1:
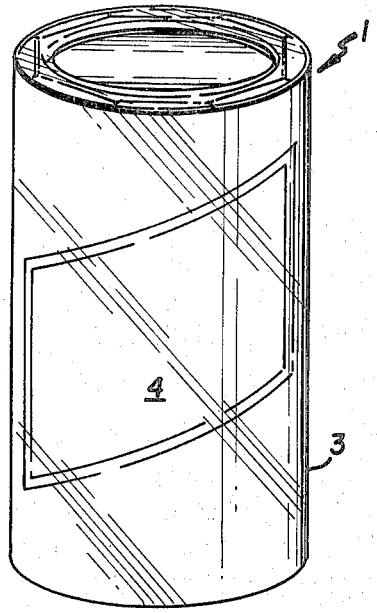
FIG. 1 shows the instant cylindrical puzzle in its fully assembled configuration.
Figure 2:
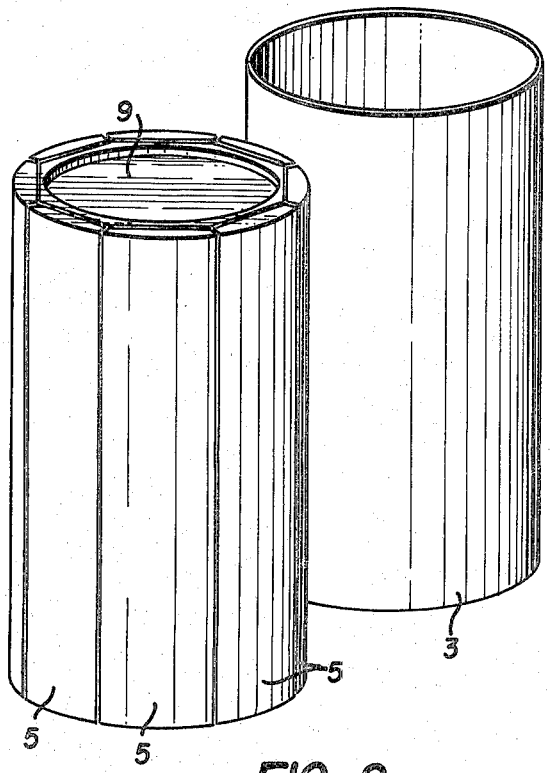
FIG. 2 shows the instant puzzle with its printed sleeve removed.
Figure 3:
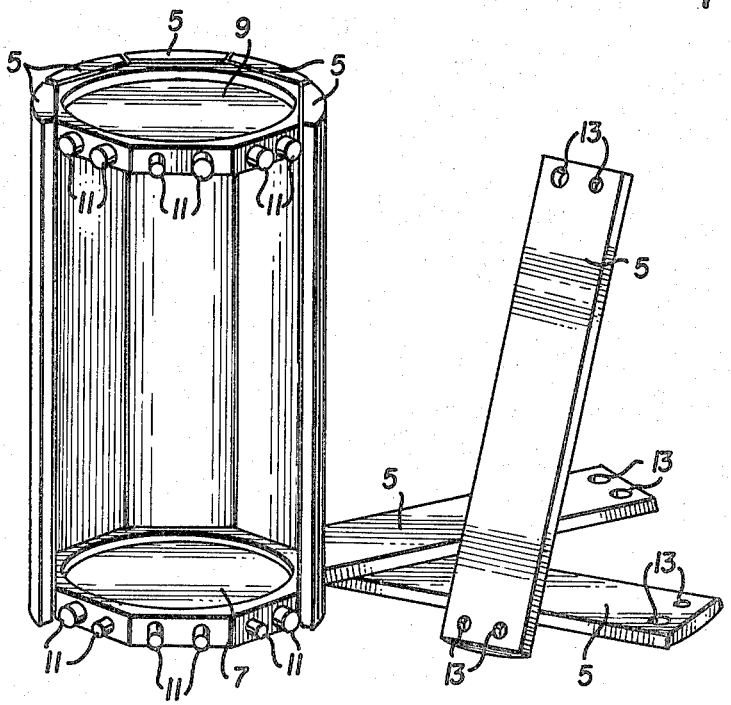
FIG. 3 shows the instant puzzle with its sleeve removed and in partially disassembled configuration.

Referring now to the drawings, FIG. 1 shows the instant cylindrical puzzle 1 in its fully assembled configuration which includes a sleeve 3 which might have indicia 4 printed thereon. FIG. 2 shows the sleeve 3 removed from the puzzle. The puzzle without the sleeve consists of ten pieces; eight side segments 5, bottom portion 7 and top portion 9. Each side segment 5 is identical in its outside dimensions, extends the full length of the puzzle between the top 9 and bottom 7 pieces or ends and encloses, for example, an arc of 45° of the cylindrical structure. Obviously, more or fewer pieces 5, covering a different arc of the cylindrical structure of the puzzle, could be utilized.

Each of the side pieces 5 is removably attached between the top 9 and bottom 7 pieces by means of pairs of posts 11, which pairs of posts fit within pairs of holes 13 molded into the side pieces 5. Each bottom piece 7 and top piece 9 have eight pairs of posts 11. Each of the side pieces 5 have two pairs of holes 13, disposed at either end thereof such that, when each side piece 5 is assembled to the correct location on the bottom 7 and top 9 pieces, they are flush with the outer surfaces thereof.

Each of the bottom 7 and top 9 pieces are formed basically in a circular shape; however, this circle is then divided into eight equal straight arcuate lengths. The pairs of posts 11 are molded to each eight straight portions of the top 9 and bottom 7 pieces. Each of the posts may preferably be of one of two different diameters. Thus, each pair of posts could contain a large and a small post, two large posts or two small posts. Obviously, the position of the large and small posts within the configuration of the pair may be reversed such that four different configurations of post pairs may be utilized. Similarly, the pairs of holes 13 contained on the side pieces 5 may have holes of two different diameters and may be configured within the pair in the same manner as described with respect to the top 9 and bottom 7 pieces. In this manner, a puzzle is formed in which, for example, the ten pieces may be assembled in only one manner. Thus, this puzzle will provide many hours of entertainment for users of all ages.

Of course, other configurations of means for attaching the side segments 5 to the top 9 and bottom 7 portions could be utilized, such as, for example, arcuate tabs and holes molded respectively to the puzzle pieces.

The disclosed puzzle may preferably be formed by injection molding apparatus from a plastic material. Alternatively, the puzzle could be formed from other materials, for example, wood, cardboard, rubber, etc.

Although only a preferred embodiment of the invention has been specifically illustrated and described herein, it is to be understood that minor modifications could be made therein without departing from the scope of the invention as defined in the appended claims.

What we claim is:

1. A geometric puzzle generally in the shape of a cylinder comprising two end portions and a plurality of removably attached side segments adapted to extend between and connect said end portions, each of said end portions having a plurality of first attaching means and each of said side segments having at least one second attaching means disposed at each end thereof configured to mate with certain ones of said first attaching means, such that said side segments may be connected to said end portions with said certain ones of said first attaching means mating with said second attaching means to thereby form a cylindrical structure, and a cylindrical cardboard sleeve which fits over the connected end portions and side segments.

2. The geometric puzzle of claim 1, wherein each of said end portions has a plurality of first attaching means thereon.

3. The geometric puzzle of claim 2, wherein each of said plurality of side segments has a like plurality of second attaching means.

4. The geometric puzzle of claim 2, wherein each of said first attaching means comprises a pair of post means attached to said end portions.

5. The geometric puzzle of claim 4, wherein each of said posts comprising said pairs of posts is of a different diameter.

6. The geometric puzzle of claim 4, wherein each of said posts comprising said pairs of posts is of the same diameter.

7. The geometric puzzle of claim 5, wherein each of said different diameter posts may be configured in either position of the pair.

8. The geometric puzzle of claims 4, 5, 6 or 7, wherein each of said side segments of said puzzle is configured with holes which mate up with a configuration of said pairs of posts.

9. The geometric puzzle of claim 1, wherein said sleeve has indicia printed thereon.

10. The geometric puzzle of claim 1, wherein each of said side segments is formed in a rectangular shape having an elongated flat planar portion on one side and an elongated arcuate plane portion on its opposite side.

11. The geometric puzzle of claim 1, wherein each of said end portions is formed in an octagonal shape.

12. The geometric puzzle of claim 11, wherein each of the octagonal faces of said end pieces is configured with said first attaching means projecting outward perpendicular to each respective octagonal face.

* * * * *